US007192327B2

(12) United States Patent
Takenaka et al.

(10) Patent No.: US 7,192,327 B2
(45) Date of Patent: Mar. 20, 2007

(54) IMAGE DISPLAY DEVICE, METHOD OF MANUFACTURING A SPACER FOR USE IN THE IMAGE DISPLAY DEVICE, AND IMAGE DISPLAY DEVICE HAVING SPACERS MANUFACTURED BY THE METHOD

(75) Inventors: Shigeo Takenaka, Tokyo (JP); Masaru Nikaido, Tokyo (JP); Satoshi Ishikawa, Tokyo (JP); Satoko Oyaizu, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/363,237

(22) Filed: Feb. 28, 2006

(65) Prior Publication Data

US 2006/0205312 A1 Sep. 14, 2006

Related U.S. Application Data

(63) Continuation of application No. 11/079,286, filed on Mar. 15, 2005, now abandoned, which is a continuation of application No. PCT/JP03/12248, filed on Sep. 25, 2003.

(30) Foreign Application Priority Data

Sep. 27, 2002 (JP) ..... 2002-283984

(51) Int. Cl.
*H01J 9/00* (2006.01)
*H01J 9/24* (2006.01)
*H01J 1/62* (2006.01)

(52) U.S. Cl. ..... 445/24; 313/495; 313/292; 313/482; 313/422

(58) Field of Classification Search ..... 445/24, 445/25

See application file for complete search history.

(56) References Cited

U.S. PATENT DOCUMENTS

| | | | | |
|---|---|---|---|---|
| 5,561,343 | A | 10/1996 | Lowe | |
| 5,675,212 | A | 10/1997 | Schmid et al. | |
| 6,262,528 | B1 | 7/2001 | Kim | |
| 6,506,087 | B1 * | 1/2003 | Fushimi et al. | 445/24 |
| 6,761,606 | B2 * | 7/2004 | Ito et al. | 445/24 |
| 6,861,798 | B1 | 3/2005 | Pan et al. | |
| 6,927,533 | B1 * | 8/2005 | Ito et al. | 313/495 |

FOREIGN PATENT DOCUMENTS

| | | |
|---|---|---|
| JP | 10-334834 | 12/1998 |
| JP | 2000-505235 | 4/2000 |

(Continued)

*Primary Examiner*—Sikha Roy
(74) *Attorney, Agent, or Firm*—Oblon, Spivak, McClelland, Maier & Neustadt, P.C.

(57) ABSTRACT

An image display device includes a first substrate which has a phosphor surface, and a second substrate which is opposed to the first substrate with a gap and has a plurality of electron sources. A plurality of spacers are arranged between the first substrate and the second substrate and support an atmospheric load acting on the first and second substrates. Each of the spacers has distal end portions at the first and second substrates, respectively. The distal end portions of each spacer are impregnated with electrically conductive material and constitute conductivity-imparting portions.

2 Claims, 4 Drawing Sheets

FOREIGN PATENT DOCUMENTS

| | | |
|---|---|---|
| JP | 2000-235831 | 9/2000 |
| JP | 2001-272926 | 10/2001 |
| JP | 2002-509337 | 3/2002 |
| JP | 2002-245956 | 8/2002 |
| JP | 2003-297265 | 10/2003 |
| KR | 2001-0031780 | 4/2001 |
| WO | WO 99/31699 | 6/1999 |
| WO | WO 01/84587 A2 | 11/2001 |

* cited by examiner

IMAGE DISPLAY DEVICE, METHOD OF MANUFACTURING A SPACER FOR USE IN THE IMAGE DISPLAY DEVICE, AND IMAGE DISPLAY DEVICE HAVING SPACERS MANUFACTURED BY THE METHOD

CROSS-REFERENCE TO RELATED APPLICATIONS

This application is a continuation of U.S. application Ser. No. 11/079,286, filed Mar. 15, 2005, now abandoned which is a Continuation Application of PCT Application No. PCT/JP03/12248, filed Sep. 25, 2003, which was published under PCT Article 21(2) in Japanese.

This application is based upon and claims the benefit of priority from prior Japanese Patent Application No. 2002-283984, filed Sep. 27, 2002. The entire contents of each of the above-cited priority documents are incorporated herein by reference.

BACKGROUND OF THE INVENTION

1. Field of the Invention

The present invention relates to an image display device that has substrates opposed to each other and a plurality of electron sources arranged on the inner surface of one of the substrates. The invention also relates to a method of manufacturing a spacer for use in the image display device and to an image display device that has spacers manufactured by the method.

2. Description of the Related Art

In recent years, there have been demands for image display devices for high-grade broadcasting or high-resolution versions therefor, which require stricter screen display performance. To meet these demands, the screen surface must be flattened and enhanced in resolution. Moreover, the devices must be lighter and thinner.

Flat image display devices, such as a field emission display (hereinafter referred to as FED), are promising as image display devices that fulfill the above requirements. The FED has a first substrate and a second substrate that are opposed to each other, with a given gap between them. The substrates have their respective peripheral edge portions joined directly or by a sidewall shaped like a rectangular frame. Thus, the substrates constitute a vacuum envelope. Phosphor layers are formed on the inner surface of the first substrate. A plurality of electron-emitting elements, which are used as electron sources that excite the phosphor layers, causing them to emit light, are provided on the inner surface of the second substrate.

A plurality of spacers, or support members, are arranged between the first and second substrates in order to support the atmospheric load that acts on these substrates. In displaying an image on the FED, anode voltage is applied to the phosphor screen, and electron beams emitted from the electron emitting elements are accelerated by the anode voltage as they hit the phosphor screen, thereby causing the phosphors to glow and display a video image.

In an FED of this type, each electron-emitting element has a size on the micrometer order, and the distance between the first substrate and the second substrate can be on the millimeter order. Thus, this image display device can achieve higher resolution and can be lighter and thinner than cathode-ray tubes (CRTs) that are used as displays of existing television receivers or computers.

The image display device of the type described above must have practical display characteristics. To this end, the anode voltage should preferably be several kilovolts or more with use of phosphors that are similar to those of a conventional cathode-ray tube. In view of the resolution and the properties and manufacturability of the support members, however, the gap between the first and second substrates cannot be large. It must be about 1 mm to about 3 mm. Inevitably, secondary electrons and reflected electrons are generated when electrons emitted from the second substrate impinge on the spacers. Consequently, the spacers are electrically charged. Generally, the spacers are charged positively at the acceleration voltage of the FED. As a result, the spacers attract the electron beams emitted from the electron-emitting elements, deflecting the electron beams from their original paths. This results in erroneous landing of the beams on the phosphor layers and ultimately lowers the color purity of the image displayed.

To reduce the attraction of electron beams to the spacers, each spacer may be rendered electrically conductive at its entire surface or at a part thereof. U.S. Pat. No. 5,726,529, for example, discloses a structure in which an insulating spacer is rendered electrically conductive at one end close to the second substrate. Thus, the spacer is prevented from being electrically charged.

If the spacers are rendered electrically conductive, however, an ineffective current flowing from the first substrate to the second substrate will increase. This raises the temperature and increases the power consumption. Further, the conventional process of rendering the spacers electrically conductive cannot help but increase the manufacturing cost.

BRIEF SUMMARY OF THE INVENTION

This invention has been made in consideration of the foregoing, and it object is to provide an image display device in which electron beams can be prevented from deviating from their paths, thereby to display images of higher quality. Another object of the invention is to provide a method of manufacturing a spacer for use in the image display device and an image display device that has spacers manufactured by the method.

In order to achieving the object, an image display device according to an aspect of the present invention comprises: a first substrate which has a phosphor surface; a second substrate which is opposed to the first substrate with a gap and has a plurality of electron sources configured to emit electron beams to excite the phosphor surface; and a plurality of spacers which are made of insulating material, are arranged between the first substrate and the second substrate and support an atmospheric load acting on the first and second substrates, each spacer having distal end portions at the first and second substrates, respectively, and the distal end portions being impregnated with electrically conductive material and constituting conductivity-imparting portions.

In the image display device thus configured, the electron beams emitted from each electron source located near one spacer is repelled by the electric field generated by the conductivity-imparting portions provided at the end portions of the spacer. The electron beam therefore travels along a path deviated from the spacer. Then, the electron beam is attracted toward the spacer, thus traveling along a path approaching the spacer. The repulsion and the attraction cancel out the deviation of the electron beam from the path. The electron beam emitted from the electron-emitting element ultimately reaches the target position on the phosphor surface. This prevents erroneous landing of the electron beam and, hence, reduces color purity. The SED can therefore display images of higher quality. The image display device can therefore display images of improved quality. In addition, the increase in temperature and the increase in power consumption can be more controlled than in image display devices having spacers that are electrically conductive as a whole.

According to another aspect of the invention, a method of manufacturing a plurality of spacers in an image display device, comprises forming spacers by using insulating material; applying paste or solution, either containing an electrically conductive component, to distal end portions of each spacer, and causing the paste or solution to permeate into the distal end portion by virtue of an capillary action; and firing each spacer into which the paste or solution has permeated, thereby providing a spacer that has, at the distal end portions, conductivity-imparting portions impregnated with electrically conductive material.

According to another aspect of the invention, a method of manufacturing a spacer comprises: forming a spacer by using insulating material; applying paste containing an electrically conductive component, to distal end portions of the spacer; and performing heat treatment on the spacer applied with the paste, diffusing the electrically conductive component in the distal end portions of the spacer, thereby providing a spacer that has, at the distal end portions, conductivity-imparting portions impregnated with electrically conductive material.

According to still another aspect of the invention, a method of manufacturing a spacer comprises: preparing dies having a plurality of through holes for forming spacers; pouring first paste containing no electrically conductive components, into the through holes; pouring second paste in which an electrically conductive component is dispersed, into the through hole, thereby applying the second paste onto the first paste; and heating the first paste and the second paste, thereby providing a spacer that has, at distal end portions, conductivity-imparting portions in which the electrically conductive component is dispersed.

DETAILED DESCRIPTION OF THE INVENTION

Embodiments of this invention, which are applied to an SED that is a flat image display device and one type of an FED, will be described in detail with reference to the accompanying drawings.

Figure 1:
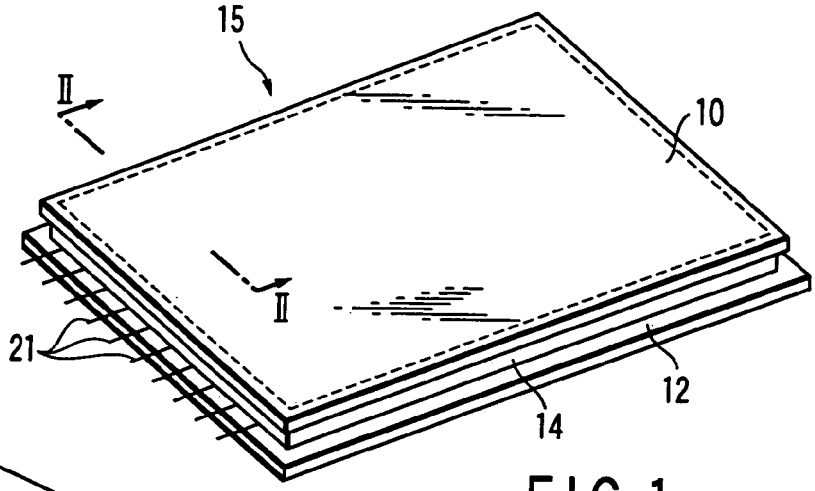
FIG. 1 is a perspective view showing a surface-emission display (hereinafter referred to as SED) according to a first embodiment of this invention.
Figure 2:
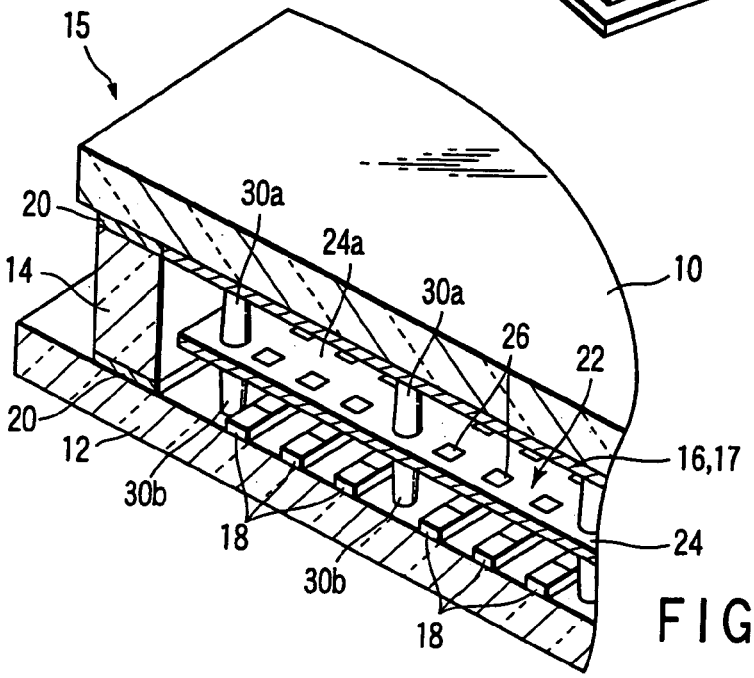
FIG. 2 is a perspective view of the SED, cut along line II—II shown in FIG. 1.
Figure 3:
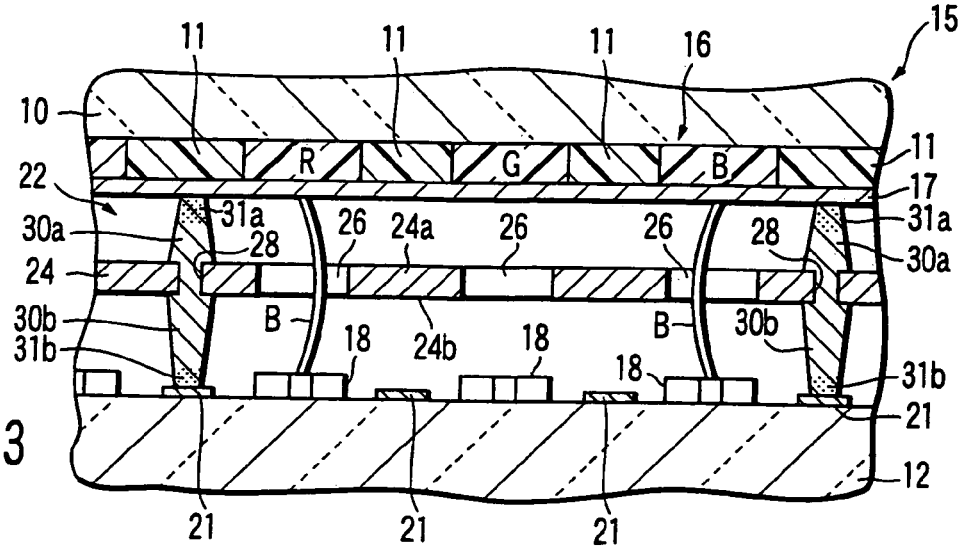
FIG. 3 is an enlarged sectional view of the SED.

As shown in FIGS. 1 to 3, the SED comprises a first substrate 10 and a second substrate 12, which are rectangular glass plates serving as transparent insulating substrates. These substrates are opposed to each other with a gap of about 1.0 to 2.0 mm between them. The second substrate 12 has a size a little greater than that of the first substrate 10. The first substrate 10 and the second substrate 12 are joined together at their peripheral edge portions, by a glass sidewall 14 shaped like a rectangular frame. Thus joined, the substrates 10 and 12 constitute a flat, rectangular vacuum envelope 15. A high vacuum is maintained inside the vacuum envelope 15.

A phosphor screen 16, or a phosphor surface, is formed on the inner surface of the first substrate 10. The phosphor screen 16 is composed of phosphor layers R, G and B and black light-shielding layers 11, which are arranged on the first substrate 10. The layers R emit red light, the layers G emit green light and the layers B emit blue light, when electrons impinge on them. The phosphor layers R, G and B are provided in the form of stripes or dots. A metal back 17 made of aluminum or the like is formed on the phosphor screen 16. A transparent electrically conductive film of, for example, ITO, or color filter film may be interposed between the first substrate 10 and the phosphor screen 16.

A large number of surface-conduction electron-emitting elements 18 are provided on the inner surface of the second substrate 12. They are electron sources and emit electron beams that excite the phosphor layers of the phosphor screen 16. The electron-emitting elements 18 are arranged in rows and columns, each provided for one pixel. Each electron-emitting element 18 has an electron-emitting portion (not shown), a pair of element electrodes that apply voltage to the electron emitting portion, and the like. A large number of wires (not shown) for applying voltage to the electron-emitting elements 18 are provided in the form of a matrix, on the inner surface of the second substrate 12. The wires are drawn at either end portion, from the vacuum envelope 15.

The sidewall 14 that serves as a joining member is sealed to the peripheral edge portions of the first substrate 10 and second substrate 12, with a sealant 20. Thus, the sidewall 14 joins the first and second substrates together. The sealant 20 is made of, for example, low-melting glass or low-melting metal.

As FIGS. 2 and 3 depict, the SED has a spacer assembly 22. The spacer assembly 22 is located between the second substrate 10 and the first substrate 12. In the present embodiment, the spacer assembly 22 has a plate-like grid 24 and a plurality of columnar spacers that are integrally formed on the both surfaces of the grid.

More specifically, the grid 24 has a first surface 24*a* and a second surface 24*b* and is located parallel to those substrates. The first surface 24*a* faces the inner surface of the first substrate 12. The second surface 24*b* faces the inner surface of the second substrate 10. The grid 24 has a number of electron-beam passage apertures 26 and a plurality of spacer openings 28. The apertures 26 and openings 28 have been made by etching or a similar process. The electron-beam passage apertures 26 are arranged, opening to the electron-emitting elements 18, respectively, and the electron beams emitted from the electron-emitting elements are passed through the respective electron-beam apertures. The spacer openings 28 are located between the electron-beam passage apertures 26 and are arranged at given pitches.

The grid 24 is a sheet of iron-nickel metal having a thickness of, for example, 0.1 to 0.25 mm. On the surfaces of the grid 24 there is formed an oxide film of the metal forming a metal film. The oxide film is made of, for example, $Fe_3O_4$ and $Fe_2NiO_4$. A high-resistance film is provided on at least that surface of the grid 24, which lies at the second substrate. The high-resistance film has been formed by applying and firing high-resistance substance that is made of glass and ceramics. The high-resistance film has resistance of E+8 Ω/□ or more.

The electron-beam passage apertures 26 are rectangular, each 0.15 to 0.25 mm wide and 0.15 to 0.25 mm long, for example. The spacer openings 28 have a diameter of about 0.2 to 0.5 mm, for example. The aforesaid high-resistance film is provided, also on the surface of the wall that defines the electron-beam passage apertures 26.

A first spacer 30*a* protrudes from, and is integrally formed with, the first surface 24*a* of the grid 24, overlapping each corresponding spacer opening 28. The extended end of each first spacer 30*a* abuts against the inner surface of the first substrate 10 via the metal back 17 and the black light-shielding layer 11 of the phosphor screen 16. A second spacer 30*b* protrudes from, and is integrally formed with, the second surface 24*b* of the grid 24, overlapping each corresponding spacer opening 28. The extended end of the second spacer 30*b* abuts against the inner surface of the second substrate 12. The extended end of the second spacer 30*b* lies above the wire 21 provided on the inner surface of the second substrate 12.

The first spacer 30*a* and second spacer 30*b* are made of insulating material. The distal end portions of the first spacer 30*a* and second spacer 30 contain electrically conductive material and constitute conductivity-imparting portions 31*a* and 31*b*, respectively. In the conductivity-imparting portions 31*a* and 31*b*, the content of the electrically conductive material gradually decreases from the distal end toward the middle potion, namely toward the grid 24.

As will be described later, the conductivity-imparting portions 31*a* and 31*b* generate an electric field. The electric field deflects the electron beams emitted from the electron-emitting elements 18, away from the first spacer 30*a* and second spacer 30. The electrically conductive material contained in the conductivity-imparting portions 31*a* and 31*b* may be, for example, Ni, In, Ag, Au, Pt, Ir, Ru, W or the like. The height of the conductivity-imparting portions 31*a* and 31*b* and the content of the conductive material are determined from the repulsion applied to the electron beams, i.e., the degree of correcting the paths of electron beams.

Each of the first and second spacers 30*a* and 30*b* is tapered so that its diameter decreases from the side of the grid 24 toward the extended end. For example, each first spacer 30*a* is formed so that the diameter of its proximal end on the side of the grid 24 is about 0.4 mm, the diameter of its extended end is about 0.3 mm, and its height is about 0.6 mm. Each second spacer 30*b* is formed so that the diameter of its proximal end on the side of the grid 24 is about 0.4 mm, the diameter of its extended end is about 0.25 mm, and its height is about 0.8 mm. Thus, the height of the second spacer 30*b* is greater than the height of the first spacer 30*a*.

The first and second spacers 30*a* and 30*b* have surface resistance of $5\times10^{13}\Omega$. Each spacer opening 28 and the first and second spacers 30*a* and 30*b* are aligned with one another. The first and second spacers 30*a* and 30*b* are connected to each other through the spacer opening 28, forming an integral part. The first and second spacers 30*a* and 30*b* are therefore formed integrally with the grid 24, clamping the grid 24 is sandwiched at both sides.

The spacer assembly 22 constructed as described above is interposed between the first substrate 10 and the second substrate 12. The first and second spacers 30*a* and 30*b* abut on the inner surfaces of the first substrate 10 and second substrate 12, respectively, bearing the atmospheric load acting on these substrates. Thus, the spacers 30*a* and 30*b* support the atmospheric load that acts on these substrates and keep the substrates spaced apart by a prescribed distance.

As FIG. 2 illustrates, the SED has a voltage supply unit (not shown) that applies voltages to the grid 24 and the metal back 17 of the first substrate 12. The voltage supply unit is connected to the grid 24 and the metal back 17. It applies a voltage of, for example, 12 kV and a voltage equal to or lower than 12 kV, to the grid 24 and the metal back 17, respectively. The voltage applied to the grid 24 is set to one equal to or higher than the voltage applied to the first substrate 10.

To make the SED display an image, an anode voltage is applied to the phosphor screen 16 and the metal back 17, and the anode voltage accelerates the electron beams B emitted from the electron-emitting elements 18, causing the beams to impinge on the phosphor screen 16 by. The beams excite the phosphor layers of the phosphor screen 16. The image is thereby displayed.

A method of manufacturing an SED of the type described above will be explained. To manufacture the spacer assembly 22, a grid 24 having a prescribed size and first and second dies 36*a* and 36*b*, both being rectangular plates of almost the same size, are prepared. In this case, a thin plate made of Fe-45–55% Ni and having thickness of 0.12 mm is degreased, washed and dried. Thereafter, electron-beam passage apertures 26 and spacer openings 28 are formed in the thin plate by etching, thus providing the grid 24. The entire grid 24 is oxidized by means of an oxidation process, forming an insulating film on the surfaces of the grid 24 and also in the inner surface of each electron-beam passage aperture 26 and the inner surface of each spacer opening 28. Further, a solution with fine oxide antimony particles dispersed in it is sprayed onto the insulating film, forming a layer of the solution. This layer of solution is dried and fired, thereby forming a high-resistance film.

Figure 4:
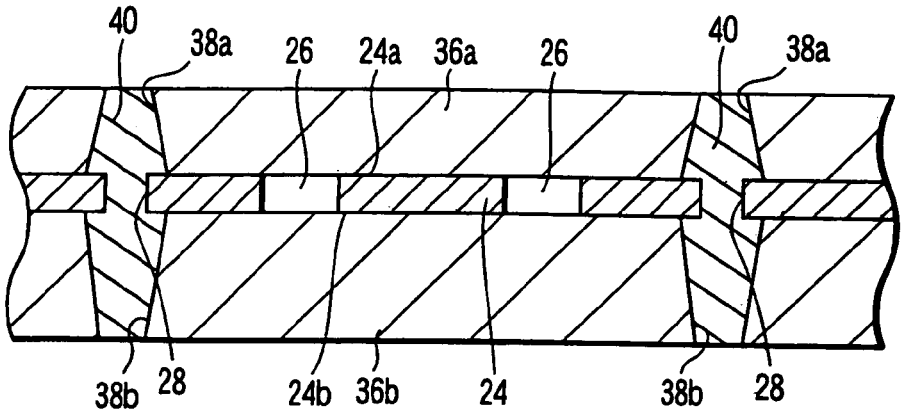
FIG. 4 is a sectional view illustrating the first and second dies attached to the grid in a step of manufacturing spacers for use in the SED.

As FIG. 4 shows, the first die 36*a* and the second die 36*b*, which serve as molds, have a through hole 38*a* and a through hole 38*b*, respectively. The holes 38*a* and 38*b* are used to form spacers. These through holes are arranged in alignment with the spacer openings 28 of the grid 24, respectively. The first and second dies 36*a* and 36*b* are coated with resin that can thermally decompose, at least on the inner surfaces of through holes 38*a* and 38*b*.

The first die 36*a* is laid on the first surface 24*a* of the grid 24, while positioned, with the through holes 38*a* is aligned with the respective spacer openings 28 of the grid 24. Likewise, the second die 36*b* is laid on the second 24*b* of the grid 24 and positioned, with the through holes 38*b* aligned with the respective spacer openings 28 of the grid 24. The first die 36*a*, grid 24, and second die 36*b* are fixed to one another by using a clamper (not shown) or the like.

Then, pasty spacer-forming material 40 is supplied, for example, from the outer surface of the first die 36*a*, filling the through holes 38*a* of the first die, the spacer openings 28 of the grid 24, and the through holes 38*b* of the second die 36*b*. A glass paste containing at least ultraviolet-curing binder (organic component) and glass filler is used as the spacer-forming material 40.

Figure 5:
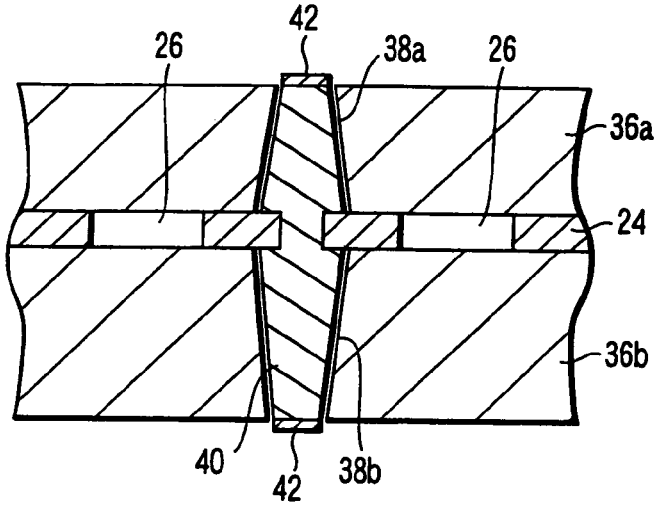
FIG. 5 is a sectional view depicting a die filled with spacer material to which UV-application and silver-past application have been performed.

Subsequently, ultraviolet (hereinafter referred to as UV) rays are applied, as radiation, to the filled spacer-forming material 40 from the outer surface side of the first and second dies 36*a* and 36*b*, curing the spacer-forming material. Thereafter, thermal curing may be performed as required. Then, the resin that is applied in the through hole 38*a* of the first die 36*a* and the through hole 38*b* of the second die 36*b* is thermally decomposed by heat treatment, providing gaps between the spacer-forming material 40 and the through holes as is illustrated in FIG. 5. Screen printing, for example, is performed, applying silver paste 42, or electrically conductive material, to both ends of each layer of spacer-forming material 40, i.e., only those portions that will be a first spacer 30 and a second spacer 30*b*. Then, the first and second dies 36*a* and 36*b* are removed from the grid 24.

Figure 6:
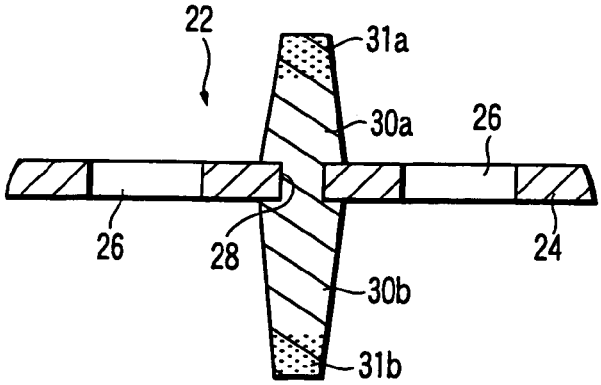
FIG. 6 is a sectional view showing a spacer removed from the die in a method of manufacturing a spacer.

Next, the grid 24 now having the first and second spacers 30*a* and 30*b* made of the spacer-forming material 40 are heat-treated in a heating oven. The binder is thereby evaporated from the spacer-forming material. Thereafter, the spacer-forming material is regularly fired at about 500 to 550° C. for 30 minutes to one hour. A spacer assembly 22, which has the first and second spacers 30*a* and 30*b*, is thereby provided on the grid 24 as shown in FIG. 6. At the same time, the silver component of the silver paste spreads over the distal ends of the first and second spacers 30*a* and 30*b*, for a distance of about 0.15 mm. As a result, the first and second spacers 30*a* and 30*b* acquire, as bulgs, conductivity-imparting portions 31*a* and 31*b*. The portions 31*a* and 31*b* contain silver in the distal end and are formed integral with the spacers 30*a* and 30*b*.

Meanwhile, the first substrate 10 and the second substrate 12 are prepared. The first substrate 10 has a phosphor screen 16 and a metal back 17. The second substrate 12 has electron-emitting elements 18 and wires 21 and is joined to the sidewall 14.

Next, the spacer assembly 22 constructed as described above is arranged on the second substrate 12. At this time, the spacer assembly 22 is positioned so that the extended ends of the second spacers 30*b* lie on the wires 21. The first substrate 10, the second substrate 12, and the spacer assembly 22 thus positioned are arranged in a vacuum chamber. The vacuum chamber is evacuated, and the first substrate is joined to the second substrate, by using the sidewall 14. An SED having the spacer assembly 22 is thereby manufactured.

As FIG. 3 shows, the electron beam B emitted from an electron-emitting element 18 located near the second spacer 30*b* is repelled by the electric field generated by the conductivity-imparting portions 31*b* that is the distal end portion of the second spacer 30*b*. The electron beam B therefore propagates toward the electron-beam passage aperture 26, while traveling in a path that deviates from the second spacer. Thereafter, the electron beam B is attracted toward the second spacer 30*b* and first spacer 30*b*, both electrically charged, and travels in a path, approaching these spacers. Then, the electron beam B is repelled by the electric field generated by the conductivity-imparting portions 31*a* that constitutes the distal end portion of the first spacer 30*a*. The beam B therefore propagates toward the phosphor screen 16, while traveling in a path that deviates from the first spacer. The repulsion and the attraction cancel out the deviation of the electron beam B from the path. The electron beam B emitted from the electron-emitting element 18 ultimately reaches the target phosphor of the phosphor screen 16.

The shorter the distance between the electron-emitting element 18 and the spacer, the longer the distance the electron beam travels toward the spacer. Conversely, the distance the electron beam moves toward the spacer is negligibly short if the distance between the electron-emitting element and the spacer is sufficiently long. The electron beam keeps moving until the secondary electrons or the reflected electrons, generated at the phosphor surface, impinge on the spacers and electrically charge the spacers. The acceleration voltage used in the SED is of such a value that the emission coefficient of secondary electrons is 1 or more. Therefore, the spacer sidewall is positively charged and attracts the electron beam toward the spacer.

In this SED, the electric field that repels electron beams from the spacers is generated, not by discharging the spacers. Rather, the electric field is generated by providing the conductivity-imparting portions 31*a* and 31*b*, respectively at the distal end portions of the first and second spacers 30*a* and 30*b* that are located near the first and second substrates 10 and 12, respectively. The heights of the conductivity-imparting portions 31*a* and 31*b* can be controlled thereby to change the intensity of the magnetic field and, ultimately, control the degree of repulsion.

Hence, the electron beam B can be prevented from deviating from the path in the SED even if the first and second spacers 30*a* and 30*b* are electrically charged and attract the electron beam B. This prevents erroneous landing of the electron beam B and, hence, reduces the degradation of color purity. The SED can therefore display images of higher quality.

Of the conductivity-imparting portions provided on the spacers, the conductivity-imparting portion 31*b* provided at the second substrate 12 is located near the electron-emitting side. The electric field generated by the conductivity-imparting portion 31*b* greatly influences the path of the electron beam. That is, the electron beam is sensitive to the electric field generated by the conductivity-imparting portion 31*b*. Thus, the path of the electron beam will greatly change even if the height of the conductivity-imparting portion 31*b*, as measured from the second substrate 12, changes a little. This is why the electron beams emitted from a plurality of electron-emitting elements move by different distances if the conductivity-imparting portions 31*b* have acquired different heights during the manufacturing process. Consequently, the paths of the electron beams can hardly be controlled accurately, by the use of only the conductivity-imparting portions 31*b* that is provided near the second substrate.

Nevertheless, the paths of the electron beams can easily be controlled with high accuracy in the SED according to the present embodiment of this invention. This is because the conductivity-imparting portions 31*a* and 31*b* are provided at the distal end portions of the first and second spacers 30*a* and 30*b*, respectively, and the action that the conductivity-imparting portion 31*b* exerts on the electron beam is mitigated. The conductivity-imparting portion 31*a* that has low sensitivity compensates for the insufficient path correction. This makes it possible to control the path of the electron beam, easily and correctly.

Thus, the conductivity-imparting portions 31*a* and 31*b* need not be made at high precision. They can therefore be manufactured easily. That is, a conductivity-imparting portion is provided at the distal end portions of both the first spacer 30*a* and the second spacer 30*b*, thus attaining the same advantage as achieved by providing a conductivity-imparting portion having a precise height on the side of the second substrate 12 only.

If the first and second spacers 30*a* and 30*b* are rendered electrically conductive in their entirety, the ineffective current that flows from the first substrate 10 to the second substrate 12 through the spacers will increase to raise the temperature and increase the power consumption. Further, the parts of each spacer, which is electrically conductive, generates gas while the SED is operating, and may cause ion impact at the electron-emitting elements that are arranged near the spacers.

In the present embodiment, the first and second spacers 30*a* and 30 have conductivity-imparting portions 31*a* and 31*b*, respectively, at the distal end portion only. Each spacer is a three-stage structure, or a conductor-insulator-conductor unit. Therefore, the spacers would not cause an increase in the ineffective current, a rise of temperature, or ion impact. The conductivity-imparting portions 31*a* and 31*b* change the electric field around the spacers, making it possible to control the path of an electron beam easily and accurately.

An SED according to the present embodiment and an SED having spacers, each not having the conductivity-imparting portions 31*a* and 31*b*, were prepared and compared in terms of the movement of electron beams. In the SED not having conductivity-imparting portions 31*a* and 31*b*, the electron beams were attracted toward the spacers by about 120 μm. In the SED according to the present embodiment, the movement of the electron beams was ±20 μm, and the color purity of image was improved, too.

In the SED, the grid 24 is arranged between the first substrate 10 and the second substrate 12, and the height of the first spacer 30*a* is smaller than that of the second spacer 30*b*. Thus, the grid 24 is closer to the first substrate 10 than to the second substrate 12. The grid 24 can therefore inhibit the discharge loss at the electron-emitting elements 18 provided on the second substrate 12, even if discharge occurs at the first substrate 10. Hence, the SED excels in resistance to discharge and can display images of improved quality.

In the SED of the structure described above, the height of the first spacer 30*a* is smaller than that of the second spacer 30*b*. The electrons emitted from the electron-emitting elements 18 can therefore reliably reach the phosphor screen even if the voltage applied to the grid 24 is higher than the voltage applied to the first substrate 10.

A method of manufacturing a spacer according to a second embodiment of this invention will be described. A grid 24 of a prescribed size is formed in the same way as in the method according to the first embodiment. Further, first and second dies 36*a* and 36 are prepared. Subsequently, the first die 36*a* is laid on the first surface 24*a* of the grid and positioned, with the through holes 38*a* aligned with the spacer openings 28 of the grid 24, as is illustrated in FIG. 4. Likewise, the second die 36*b* is laid on the second surface 24*b* of the grid 24 and positioned, with the through hole 38*b* aligned with the spacer opening 28 of the grid 24. The first die 36*a*, grid 24, and second die 36*b* are fixed to one another by using a clamper (not shown) or the like.

Then, pasty spacer-forming material 40, for example, is supplied from the outer surface of the first die 36*a*, filling the through holes 38*a* of the first die, the spacer openings 28 of the grid 24, and the through holes 38*b* of the second die 36*b*. An insulating glass paste containing at least UV-curing binder (organic component) and glass filler is used as the spacer-forming material 40.

Figure 7:
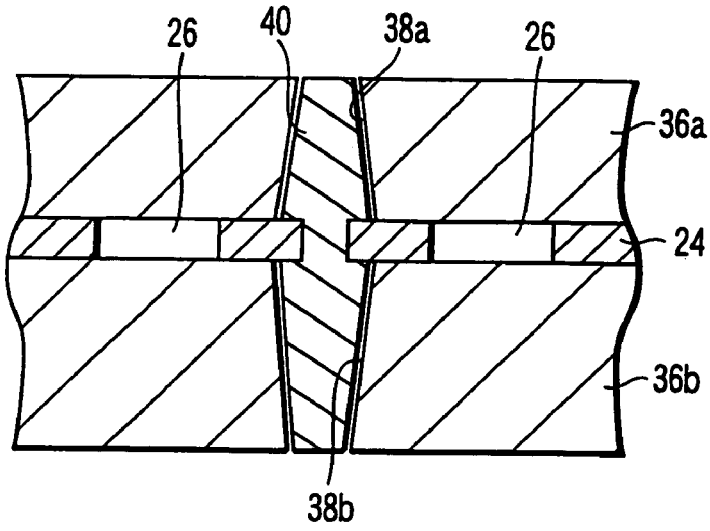
FIG. 7 is a sectional view illustrating a method of manufacturing a spacer for use in the SED, which is a second embodiment of this invention.

Subsequently, UV rays are applied to the filled spacer-forming material 40 from the outer surface side of the first and second dies 36*a* and 36*b*, curing the spacer-forming material. Thereafter, thermal curing may be performed as required. Then, the resin that is applied in the through hole 38*a* of the first die 36*a* and the through hole 38*b* of the second die 36*b* is thermally decomposed by heat treatment, providing gaps between the spacer-forming material 40 and the through holes as is illustrated in FIG. 7. Thereafter, the first and second dies 36*a* and 36*b* are removed from the grid 24.

Figure 8:
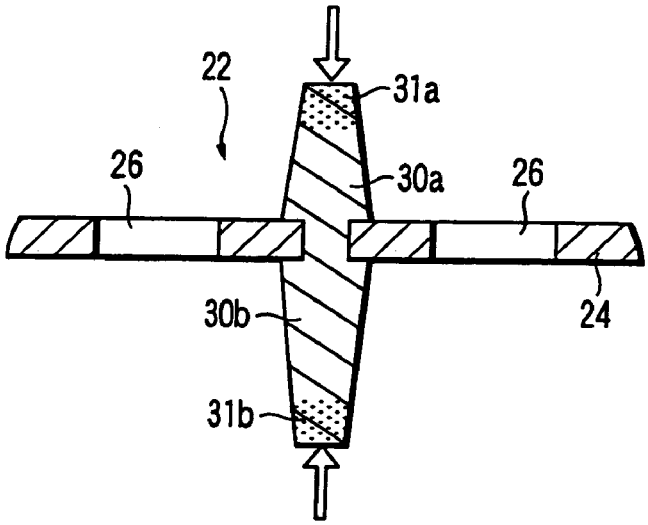
FIG. 8 is a sectional view explaining a step of applying a solution to the tip of a spacer in the method according to the second embodiment, said solution containing electrically conductive component.

Next, the grid 24 now having the first and second spacers 30*a* and 30*b* made of the spacer-forming material 40 are heat-treated in a heating oven. The binder is thereby evaporated from the spacer-forming material. The binder is thereby removed. Thereafter, a solution composed of very fine silver particles and etradecane solution is applied by, for example, ink-jet process, to the distal end of the first spacer 30*a* and the distal end of the second spacer 30*b* as shown in FIG. 8, while the spacer-forming material 40 remains porous before it is fired. The solution applied permeates into the distal end portions of the first and second spacers 30*a* and 30*b* to the depth of about 0.2 mm by virtue of a capillary action.

Then, the grid 24 having the first and second spacers 30*a* and 30*b* is placed in a heating oven. The grid 24 is regularly fired at about 500 to 550° C. for 30 minutes to one hour. The firing makes the glass grains constituting the spacer-forming material fuse together. A spacer assembly 22 is thereby obtained. At the same time, first and second spacers 30*a* and 30*b* having, as bulgs, conductivity-imparting portions 31*a* and 31*b* are obtained. The conductivity-imparting portions 31*a* and 31*b* have a distal end portion each, which contains silver.

Thereafter, the first substrate 10, spacer assembly 22 and second substrate are coupled in the same method as in the first embodiment. As a result, an SED having the spacer assembly 22 is manufactured.

An SED according to the present embodiment and an SED having spacers, each not having the conductivity-imparting portions 31*a* and 31*b*, were prepared and compared in terms of the movement of electron beams. In the SED not having conductivity-imparting portions 31*a* and 31*b*, the electron beams were attracted toward the spacers by about 120 μm. In the SED according to the present embodiment, the movement of the electron beams was ±20 μm, and the color purity of image was improved, too.

This embodiment is identical to the first embodiment in other structural respects. The components identical to those of the first embodiment are designated at the same reference numerals and will not describe in detail. The SED having spacers made by the method according to the second embodiment can achieve the same advantages as the first embodiment.

Figure 9:
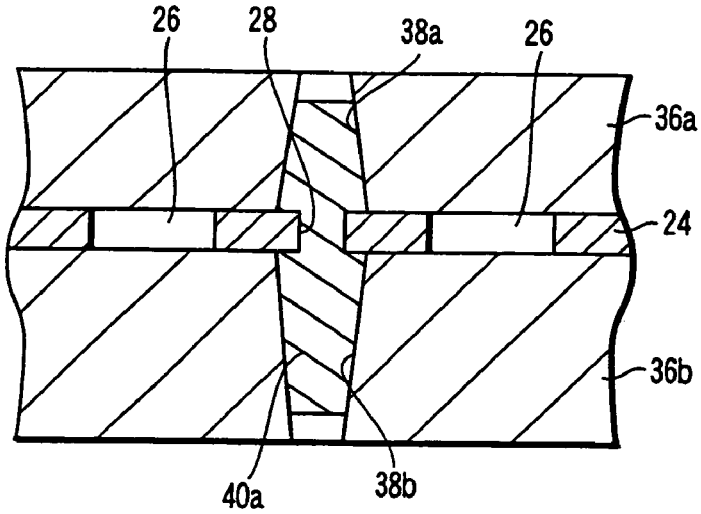
FIG. 9 is a sectional view explaining a method of manufacturing spacers for use in the SED, which is a third embodiment of this invention.
Figure 10:
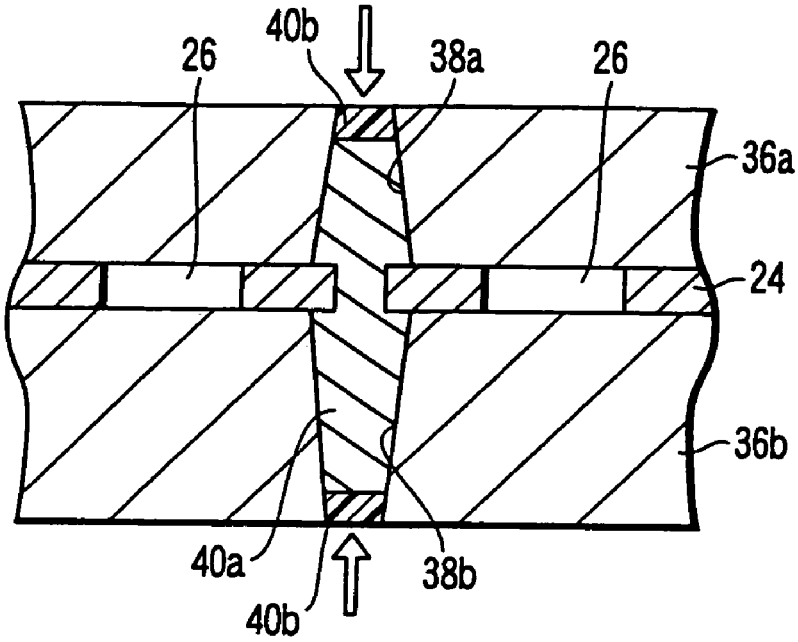
FIG. 10 is a sectional view depicting a die filled with first paste and second paste, in the method of manufacturing spacers, according to the third embodiment.

A method of manufacturing a spacer according to a third embodiment of this invention will be described. A grid 24 is formed in the same way as in the method according to the first embodiment. Further, first and second dies 36*a* and 36*b* are prepared. Subsequently, the first die 36*a* is laid on the first surface 24*a* of the grid and positioned, with the through holes 38*a* aligned with the spacer openings 28 of the grid 24, as is illustrated in FIG. 9. Likewise, the second die 36*b* is laid on the second surface 24*b* of the grid 24 and positioned, with the through hole 38*b* aligned with the spacer opening 28 of the grid 24. The first die 36*a*, grid 24, and second die 36*b* are fixed to one another by using a clamper (not shown) or the like.

Then, first paste 40*a*, used as spacer-forming material, is supplied from the outer surface of the first die 36*a*, filling the through holes 38*a* of the first die, the spacer openings 28 of the grid 24, and the through holes 38*b* of the second die 36*b*. The end portions of the through holes 38*a* and 38*b* are not filled with the first paste 40*a*, leaving some space in these holes 38*a* and 38*b*. The first paste 40*a* is insulating glass paste that contains UV-curing binder and glass filler. It is paste that contains no electrically conductive components.

Subsequently, second paste 40*b*, used as spacer-forming material, is supplied from the outer surface of the second die 36*b* into the end portions of the through holes 38*a* and 38*b*, on top of the first paste 40*a*. The second paste 40*b* is glass paste that contains UV-curing binder (organic component), glass filler and Au particles. The Au particles are used as electrically conductive component.

Next, UV rays are applied to the first and second pastes 40*a* and 40*b* thus applied, from the outer surface side of the first and second dies 36*a* and 36*b*. The first and second pastes 40*a* and 40*b* are cured with the UV rays. Thereafter, thermal curing may be performed as required. Then, the resin applied in the through hole 38*a* of the first die 36*a* and the through hole 38*b* of the second die 36*b* is thermally decomposed by heat treatment. Gaps are thereby provided between the spacer-forming material 40 and the through holes. Thereafter, the first and second dies 36*a* and 36*b* are removed from the grid 24.

Figure 11:
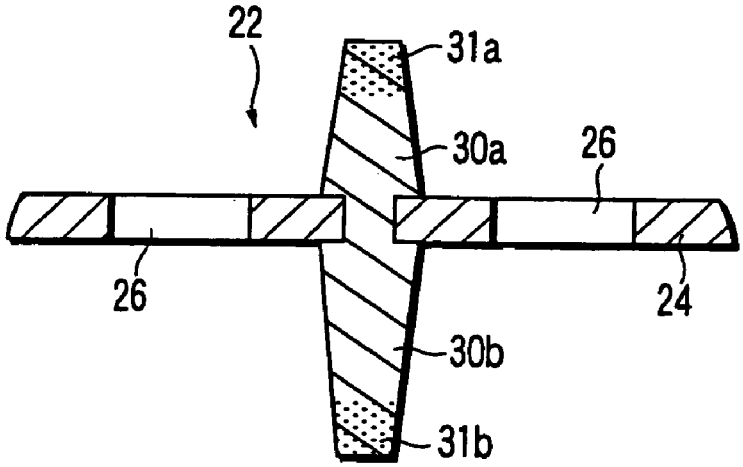
FIG. 11 is a sectional view showing a spacer removed from the die in the method of manufacturing a spacer, according to the third embodiment.

The grid 24 now having the first and second spacers 30*a* and 30*b* made of the first and second pastes 40*a* and 40*b* are heat-treated in a heating oven. The binder is thereby evaporated from the first and second pastes 40*a* and 40*b*. The binder is thereby removed. Further, the first and second pastes 40*a* and 40*b* are regularly fired at about 500 to 550° C. for 30 minutes to one hour. A spacer assembly 22 is thereby provided, which has first and second spacers 30*a* and 30*b* formed on the grid 24 as is shown in FIG. 11. At the same time, first and second spacers 30*a* and 30*b* are obtained, whose distal end portions have, as bulgs, conductivity-imparting portions 31*a* and 31*b* containing dispersed Au.

Thereafter, the first substrate 10, spacer assembly 22 and second substrate are coupled in the same method as in the first embodiment. As a result, an SED having the spacer assembly 22 is manufactured.

An SED according to this embodiment and an SED having spacers, each not having the conductivity-imparting portions 31*a* and 31*b*, were prepared and compared in terms of the movement of electron beams. In the SED not having conductivity-imparting portions 31*a* and 31*b*, the electron beams were attracted toward the spacers by about 120 μm. In the SED according to the present embodiment, the movement of the electron beams was ±20 μm, and the color purity of image was improved, too.

The third embodiment is identical to the first embodiment in other structural respects. The components identical to those of the first embodiment are designated at the same reference numerals and will not describe in detail. The SED having spacers made by the method according to the third embodiment can achieve the same advantages as the first embodiment.

The present invention is not limited to the embodiments described above. Various modifications can be made within the scope of the invention. For example, the invention is not limited to image display devices having a grid. It can be applied to image display devices that have no grids. In this case, spacers integrally formed, shaped like either a column or a plate, are used, and each spacer has two conductivity-imparting portions at the distal ends that face the first and second substrates, respectively. Such devices can attain the same advantages as the embodiments described above.

The height of the spacers, the sizes, materials and the like of the other components can be changed if necessary. In the above-described embodiments, the end of each spacer, which is provided on the second substrate, is located above the wires provided on the second substrate. Nonetheless, it may be located at any other position so long as it is spaced apart from the electron-emitting elements.

The grid 24 and the first substrate may be set at the same potential. If this is the case, the first spacer may be impregnated with electrically conductive material and thereby rendered electrically conductive in its entirety.

In the embodiments described above, the first and second spacers have a distal end portion each, which imparts electrical conductivity. Nonetheless, only the second spacer may have a conductivity-imparting portion at the end facing the second substrate. Using this spacer, the SED may be constituted.

The electron sources are not limited to surface-conductive electron-emitting elements. Thus, the present invention can be applied to any FED that uses electron sources that emits electrons in a vacuum, such as field-emission elements or carbon nano-tubes.

What is claimed is:

1. A method of manufacturing a plurality of spacers in an image display device that comprises a first substrate having a phosphor surface, a second substrate opposed to the first substrate with a gap and having a plurality of electron sources configured to emit electron beams to excite the phosphor surface, the plurality of spacers being made of insulating material, arranged between the first substrate and the second substrate and supporting an atmospheric load acting on the first and second substrates, the method comprising:

forming spacers by using insulating material;

applying paste or solution, either containing an electrically conductive component, to at least one of distal end portions of each spacer, and causing the paste or solution to permeate into the distal end portion by virtue of capillary action; and firing each spacer into which the paste or solution has permeated, thereby providing a spacer that has, at at least one of the distal end portions, a conductivity-imparting portion impregnated with electrically conductive material.

2. The method of manufacturing a spacer according to claim 1, wherein the paste is applied to the distal end portions of each spacer, thereby providing a spacer that has, at the distal end portions, conductivity-imparting portions impregnated with electrically conductive material.

* * * * *